US010994547B2

(12) United States Patent
Murphy et al.

(10) Patent No.: US 10,994,547 B2
(45) **Date of Patent: *May 4, 2021**

(54) HOUSING FOR A CARRIAGE ASSEMBLY

(71) Applicant: Hewlett-Packard Development Company L.P., Houston, TX (US)

(72) Inventors: Bryan Murphy, Kildare (IE); Sarah Russell, San Diego, CA (US); Jesse Phillips, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/754,384

(22) PCT Filed: Sep. 4, 2015

(86) PCT No.: PCT/EP2015/001788

§ 371 (c)(1),
(2) Date: Feb. 22, 2018

(87) PCT Pub. No.: WO2017/036489

PCT Pub. Date: Mar. 9, 2017

(65) Prior Publication Data

US 2018/0236774 A1 Aug. 23, 2018

(51) Int. Cl.
*B41J 2/175* (2006.01)
*B41J 29/02* (2006.01)

(52) U.S. Cl.
CPC ..... *B41J 2/17523* (2013.01); *B41J 2/175* (2013.01); *B41J 2/1752* (2013.01); *B41J 2/1753* (2013.01); *B41J 2/17553* (2013.01); *B41J 29/02* (2013.01)

(58) Field of Classification Search
CPC ..... B41J 2/17523; B41J 2/17509
See application file for complete search history.

(56) References Cited

U.S. PATENT DOCUMENTS 5,751,322 A 5/1998 Miller et al.
6,030,073 A * 2/2000 Coiner ..... B41J 2/17509 347/84
6,481,838 B1 11/2002 Brugue et al.
(Continued)

FOREIGN PATENT DOCUMENTS

CN 1316334 10/2001
CN 1517221 8/2004
(Continued)

OTHER PUBLICATIONS

International Searching Authority, "Search Report," issued in connection with PCT patent application No. PCT/EP2015/001788, dated May 12, 2016, 5 pages.
(Continued)

*Primary Examiner* — Lam S Nguyen
(74) *Attorney, Agent, or Firm* — HP Inc. Patent Department

(57) ABSTRACT

Provided in one example is an articulating housing for carriage assembly of a printer system, the articulating housing comprising an articulating housing coupling part for establishing an articulated coupling between the articulating housing and the carriage assembly, as well as a carriage assembly and a printer system comprising such an articulating housing.

15 Claims, 9 Drawing Sheets

(56) References Cited

U.S. PATENT DOCUMENTS

| | | | | |
|---|---|---|---|---|
| 6,508,547 | B2 | 1/2003 | King et al. | |
| 7,114,800 | B2 | 10/2006 | Tsujimoto | |
| 7,207,666 | B2 | 4/2007 | Ord et al. | |
| 7,384,124 | B2 | 6/2008 | Yang | |
| 8,272,722 | B2 | 9/2012 | Iijima | |
| 2003/0025763 | A1 | 2/2003 | Sturgeon et al. | |
| 2012/0268534 | A1* | 10/2012 | Gomez | B41J 2/17523 347/86 |
| 2013/0135373 | A1 | 5/2013 | Price | |

FOREIGN PATENT DOCUMENTS

| | | |
|---|---|---|
| CN | 101357538 | 2/2009 |
| CN | 202180642 | 4/2012 |
| JP | 3219326 | 10/2001 |
| JP | 2003211700 | 7/2003 |
| JP | 2006150804 | 6/2006 |

OTHER PUBLICATIONS

International Searching Authority, "Written Opinion," issued in connection with PCT patent application No. PCT/EP2015/001788, dated May 12, 2016, 6 pages.

State Intellectual Property Office of China, "First Office Action," issued in connection with Chinese Application No. 2015800823838.2, dated Feb. 11, 2019, 8 pages.

* cited by examiner

HOUSING FOR A CARRIAGE ASSEMBLY

BRIEF DESCRIPTION OF THE DRAWINGS

The present disclosure contain the accompanying drawings, in which corresponding reference numerals indicate corresponding parts and in which.

DETAILED DESCRIPTION

Figure 1A:
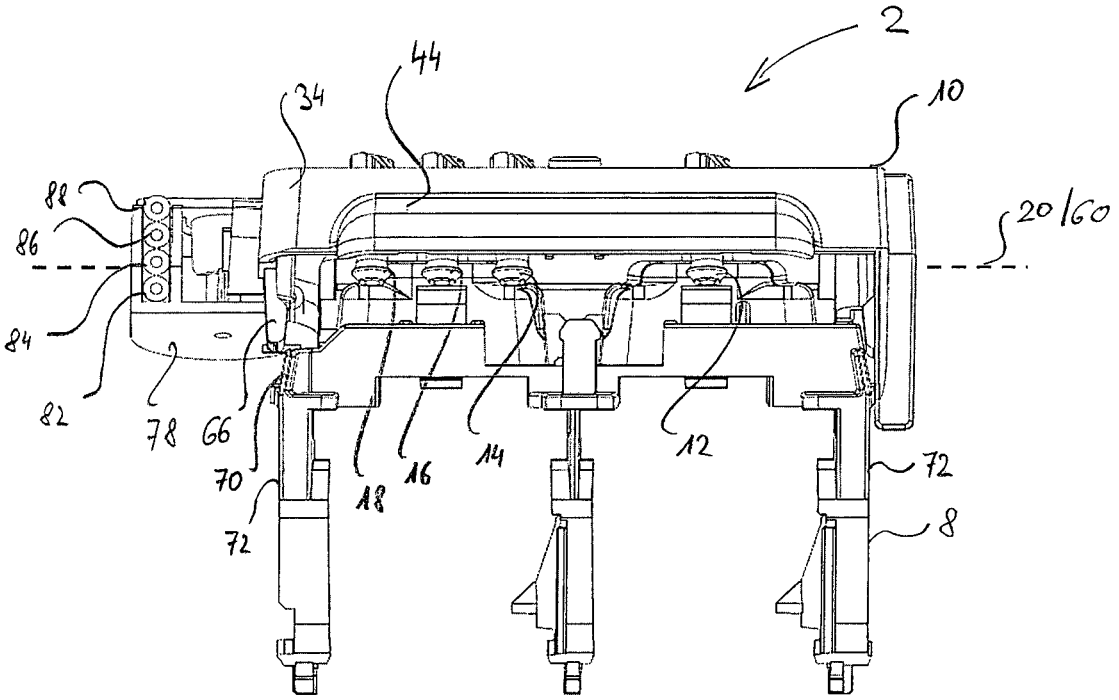
FIG. 1*a* is an illustration of an example carriage assembly for a printer system in front view.

Various aspect will be described below by referring to the figures. Features with similar properties or functions, which are shown in multiple figures, are referred to by the same reference numerals and will be explained upon their first mention. However, before proceeding further with a detailed description of the figures, further aspects are discussed According to an aspect, there is provided an articulating housing for a carriage assembly of a printer system. The carriage assembly may comprise a cartridge holding part for replaceably holding the at least one replaceable cartridge and a carriage assembly coupling part. The at least one replaceable cartridge respectively may comprise at least one cartridge input port for a supply of printing fluid to the replaceable cartridge.

The articulating housing may comprise at least one articulating housing output port for supplying printing fluid to a respective one of the at least one cartridge input port.

The articulating housing may comprise an articulating housing coupling part for establishing an articulated coupling between the articulating housing and the carriage assembly coupling part to pivot the articulating housing around an articulating housing pivot axis from a first articulating housing pivot position, in which the at least one articulating housing output port respectively is not fluidly connected to the respective one of the at least one cartridge input port, to a second articulating housing pivot position, in which the at least one articulating housing output port respectively is fluidly connected to the respective one of the at least one cartridge input port.

The articulating housing coupling part may comprise a latch for establishing a hinge joint type coupling with the carriage assembly coupling part.

The carriage assembly may comprise at least one cartridge latch each for latching a respective one of the at least one replaceable cartridge in the carriage assembly, wherein the at least one cartridge latch respectively may be pivotable about a cartridge latch pivot axis from a first cartridge latch position for releasing the respective one of the at least one replaceable cartridge from the carriage assembly into a second first cartridge latch position for latching the respective one of the at least one replaceable cartridge in the carriage assembly, wherein the articulating housing pivot axis is axially aligned with the cartridge latch pivot axis.

The at least one articulating housing output port respectively may comprise a flexible needle type connector.

The articulating housing may comprise a holding part for holding the articulating housing in the first articulating housing pivot position and for holding the articulating housing in the second articulating housing pivot position.

The holding part may comprise a latch leg for engaging with a first engagement part of the carriage assembly in the first articulating housing pivot position and for engaging with a second engagement part of the carriage assembly in the second articulating housing pivot position.

In the case the second engagement part of the carriage assembly comprises a recess, the latch leg may be for engaging the second engagement part of the carriage assembly to establish a releasable latch coupling of the articulating housing and the carriage assembly.

In the case the carriage assembly comprises a carriage assembly stop part, the articulating housing may comprise an articulating housing stop part for engaging with the carriage assembly stop part in the first articulating housing pivot position.

The at least one articulating housing output port may comprise at least two articulating housing output ports being arranged in linear fashion parallel to the articulating housing pivot axis.

At least some of the at least two articulating housing output ports may be evenly spaced.

The at least one articulating housing output port may comprise at least three articulating housing output ports, wherein at least two of the at least three articulating housing output ports are evenly spaced in a first output port area of the articulating housing and at least one of the at least three articulating housing output ports is arranged in a second output port area of the articulating housing.

The articulating housing may comprise, for each of the at least one articulating housing output port, an articulating housing input port for a fluid connection to a printing fluid source of the printer system and supply of printing fluid a respective one of the at least one articulating housing output port.

The articulating housing may have features for controlling and/or securing at least one printing fluid supply tube. Examples of the features may include a printing fluid supply tube support. Also, a feature may include a tube cap that may be used to control and/or secure at least one printing fluid supply tube, particularly in the printing fluid supply tube support.

As set forth further, below a printing fluid supply tube support may be comprised by the carriage assembly referred to in the following.

According to another aspect, there is provided a carriage assembly for at least one replaceable cartridge for a printer system. The at least one replaceable cartridge respectively may comprise at least one cartridge input port for supply of printing fluid thereto.

The carriage assembly may comprise a cartridge holding part for replaceably holding the at least one replaceable cartridge.

The carriage assembly may comprise a carriage assembly coupling part.

The carriage assembly may comprise an articulating housing as set forth above. The articulating housing coupling part may be articulatedly coupled to the carriage assembly coupling part to pivot the articulating housing around an articulating housing pivot axis from a first articulating housing pivot position, in which the at least one articulating housing output port respectively is not fluidly connected to the respective one of the at least one cartridge input port, to a second articulating housing pivot position, in which the articulating housing output port respectively is fluidly connected to the respective one of the at least one cartridge input port.

Articulating, articulatedly coupled and the like may indicate that the articulating housing coupling part and the carriage assembly coupling part are connected or coupled—directly to each other or indirectly by an intermediate member—by a joint, hinge, link and the like enabling a pivot movement of the articulating housing coupling part and the carriage assembly coupling part with respect to each other.

The carriage assembly may comprise at least one cartridge latch each for latching a respective one of the at least one replaceable cartridge in the carriage assembly, wherein the at least one cartridge latch respectively may be pivotable about a cartridge latch pivot axis from a first cartridge latch position for releasing the respective one of the at least one replaceable cartridge from the carriage assembly into a second first cartridge latch position for latching the respective one of the at least one replaceable cartridge in the carriage assembly, wherein the articulating housing pivot axis is axially aligned with the cartridge latch pivot axis.

The carriage assembly may comprise a first engagement part of the carriage assembly being engaged with the articulating housing in the first articulating housing pivot position and a second engagement part being engaged with the articulating housing in the second articulating housing pivot position.

The second engagement part of the carriage assembly may comprise a recess.

The carriage assembly may comprise a carriage assembly stop part being engaged with the articulating housing in the first articulating housing pivot position.

The carriage assembly may comprise a printing fluid supply tube support for supporting at least one printing fluid supply tube for fluid connection with a printing fluid supply of the printer system and supplying the printing fluid to a respective one of the at least one articulating housing output port.

The printing fluid supply support may comprise the carriage assembly stop part.

According to another aspect, there is provided a printer system comprising a carriage assembly as set forth above.

Figure 1B:
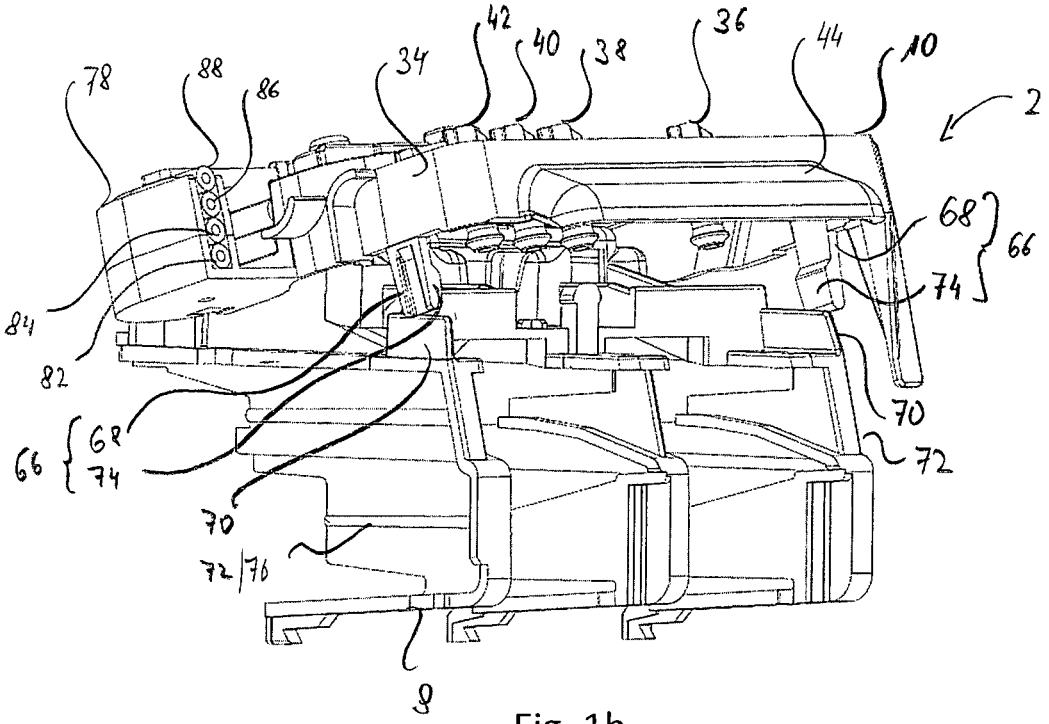
FIG. 1*b* is an illustration of an example carriage assembly for a printer system in perspective view.

FIG. 1*a* is a front view of an example carriage and FIG. 1*b* is a perspective view illustration of an example carriage The carriage assembly 2 is for the replaceable installation of replaceable cartridges 4 and 6 (shown in e.g. FIGS. 2, 3 and 4) in a printer system. The replaceable cartridges 4 and 6 can be installed in the carriage assembly 2 by inserting the replaceable cartridges 4 and 6 into a holding part 8 of the carriage assembly 2. The holding part 8 can be also referred to as "pen chute".

The carriage assembly 2 is adapted to hold the inserted replaceable cartridges 4 and 6 at predefined positions. The carriage assembly 2 of FIGS. 1*a* and 1*b* is for the installation of two replaceable cartridges. Other carriage assemblies may be arranged to accommodate one, three, four, or any another number of replaceable cartridges.

The carriage assembly 2 comprises an articulating housing 10 including articulating housing output ports 12, 14, 16 and 18 to supply printing fluid to the replaceable cartridges 4 and 6. For/in operation of the printer system, the articulating housing output ports 12, 14, 16 and 18 are fluidly connected to ink tanks located remotely. The articulating housing 10 of Figs. has four articulating housing output ports, which are formed as flexible needles. An articulating housing may have another number of articulating housing output ports, such as one, two, three, five and six articulating housing output ports. The articulating housing output ports may have forms different from the flexible needle form.

The articulating housing 10 is arranged in the carriage assembly 2 to pivot around an articulating housing pivot axis 20. The articulating housing 10 can pivot around the articulating housing pivot axis 20 between a first articulating housing pivot position and a second articulating housing pivot position. The first articulating housing pivot position is shown in, e.g., FIGS. 1*a*, 1*b*, 4*a* and 9, while the second articulating housing pivot position is shown in, e.g., FIGS. 3*a*, 4*b*, 7*a*, 7*b* and 8.

Figure 2A:
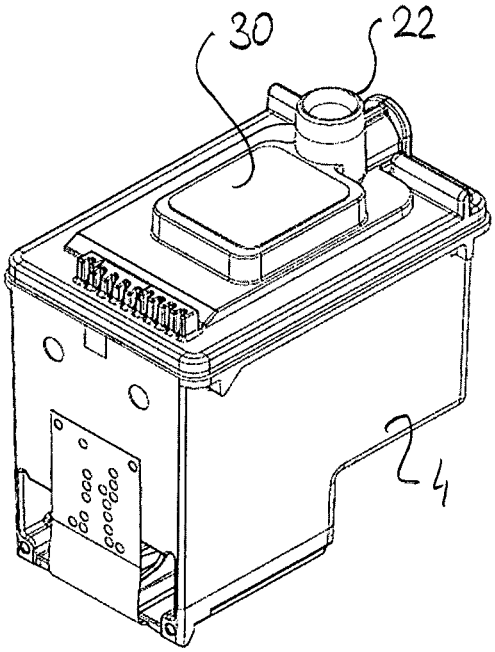
FIG. 2*a* is an illustration of an example replaceable cartridge with one cartridge input port.
Figure 2B:
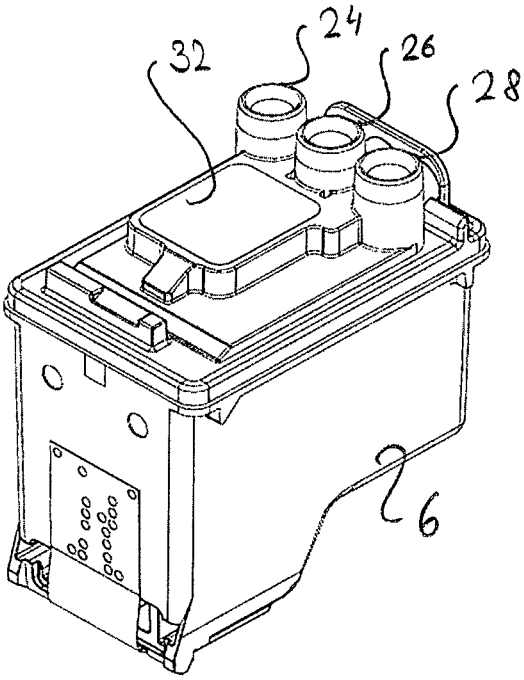
FIG. 2*b* is an illustration of an example replaceable cartridge with three cartridge input ports.

FIG. 2*a* and FIG. 2*b* are schematic illustrations of example replaceable cartridges 4 and 6, which can be installed in the carriage assembly 2.

The replaceable cartridge 4 in FIG. 2*a* is illustrated as a cartridge that is supplied with a single printing fluid type, for having a specific color (e.g. black) and/or property. To this end, the replaceable cartridge 4 comprises a single cartridge input port 22, to which printing fluid from a single printing fluid source of the printer system can be supplied. Cartridges of the type of the replaceable cartridge 4 may be referred to as "single printing fluid cartridge".

The replaceable cartridge 6 in FIG. 2*b* is illustrated as a cartridge that is supplied with up to three different printing fluid types, for having different colors (e.g. red, green, blue) and/or properties. To this end, the replaceable cartridge 6 comprises three cartridge input ports 24, 26 and 28, to each of which printing fluid from a single printing fluid source of the printer system can be supplied. In other aspects, at least two of the cartridge input ports 24, 26 and 28 can by supplied with printing fluid from the same printing fluid source of the printer system. Cartridges of the type of the replaceable cartridge 6 may be referred to as "triple printing fluid cartridge".

Further replaceable cartridges may have two, four, five, six, or any other number of cartridge input ports. Such cartridges may be referred to as "multi printing fluid cartridges".

According to the illustrations, the cartridge input port 22 is formed as tube socket, extending from an upper part 30 of the replaceable cartridge 4. Also according to the illustration, the cartridge input ports 24, 26 and 28 are formed as tube sockets each thereof extending from an upper part 32 of the replaceable cartridge 6.

The cartridge input ports may be differently formed. In general, it can be said that any form of cartridge input port can be used as long as its form allows a coupling, engagement and the like with an articulating housing output port.

Figure 3A:
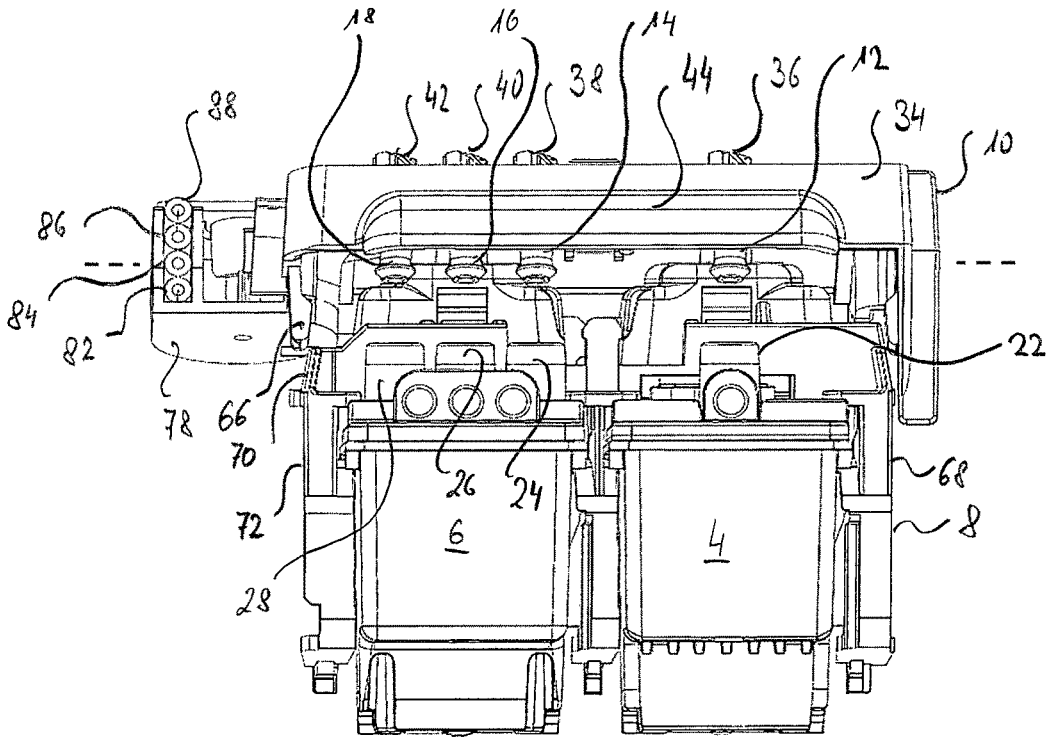
FIG. 3*a* is an illustration of an example carriage assembly for a printer with an articulating housing in a first articulating housing pivot position.
Figure 3B:
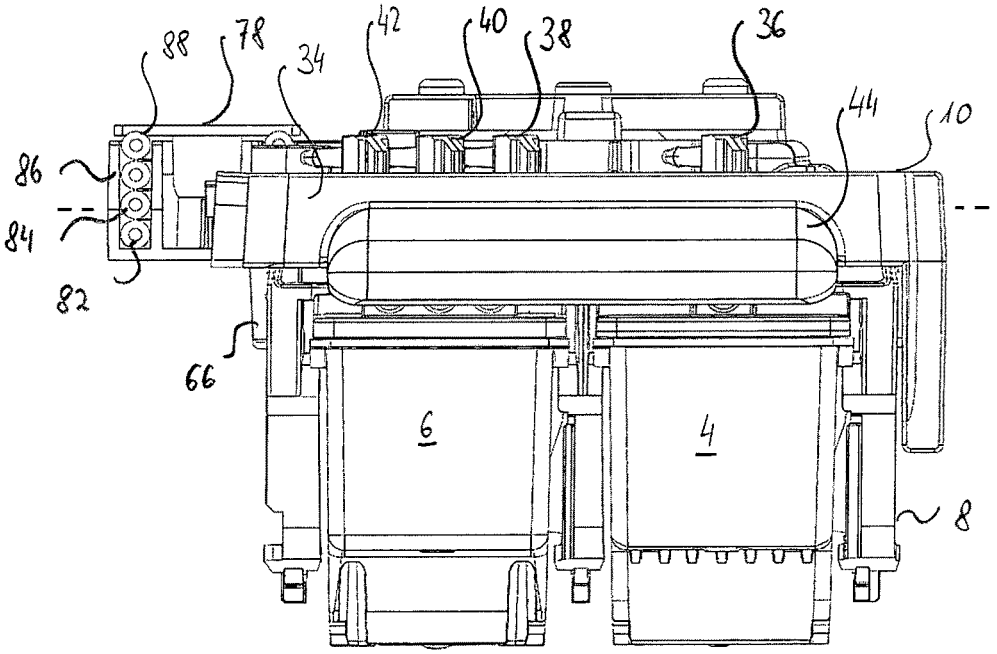
FIG. 3*b* is an illustration of the carriage assembly of FIG. 3*a* in a second articulating housing pivot position in one example.
Figure 4:
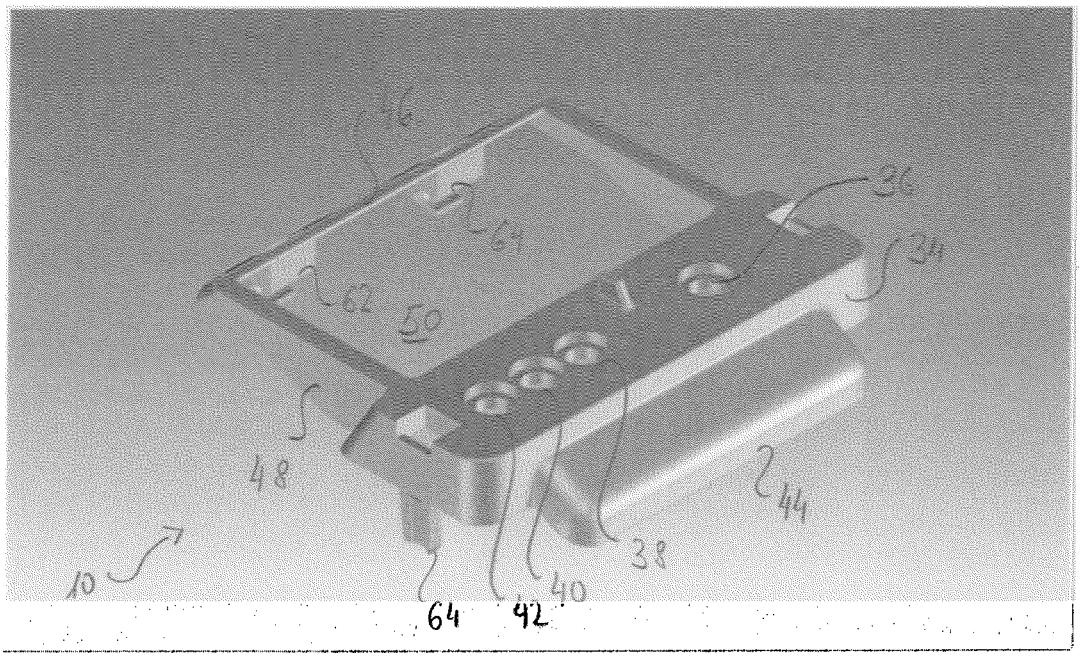
FIG. 4 is an illustration of an example articulating housing.
Figure 5:
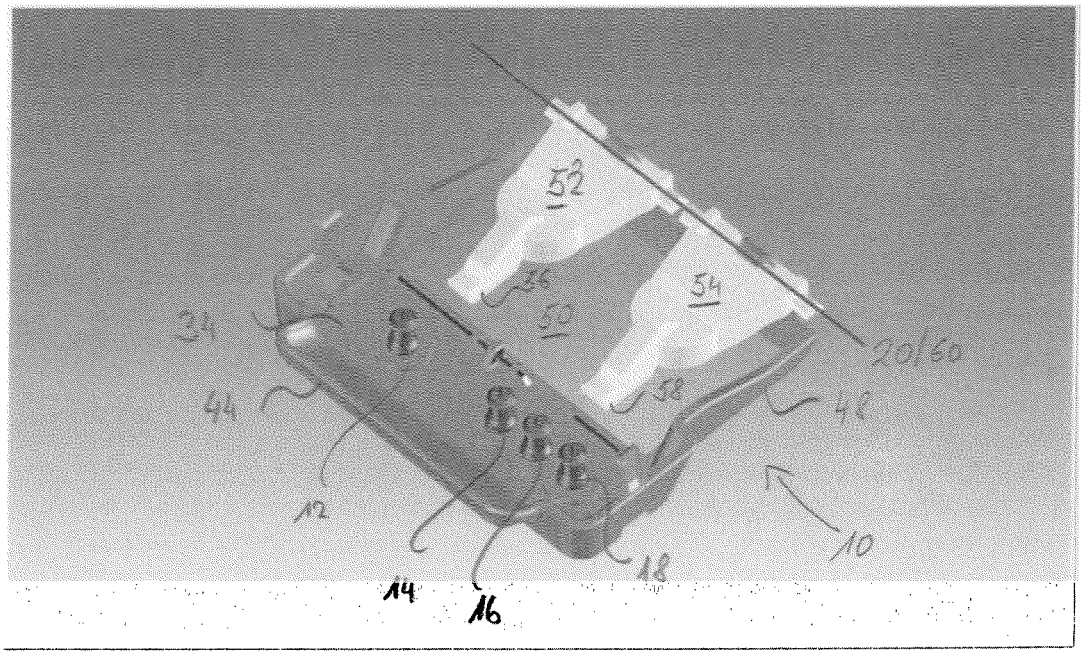
FIG. 5 is an illustration of an underside of the articulating housing of FIG. 4 coupled with cartridge latches in one example.
Figure 6A:
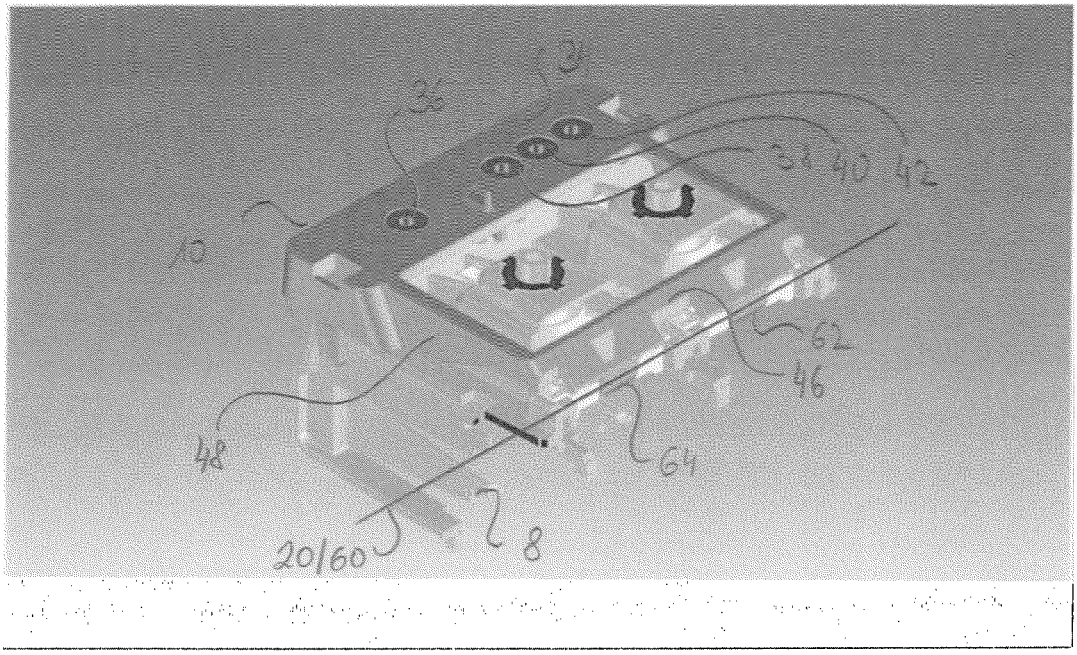
FIGS. 6*a* and 6*b* are illustrations in different perspectives of the articulating housing of FIG. 4 arranged on a cartridge holding part of an carriage assembly in one example, wherein the articulating housing in a first articulating housing pivot position.
Figure 6B:
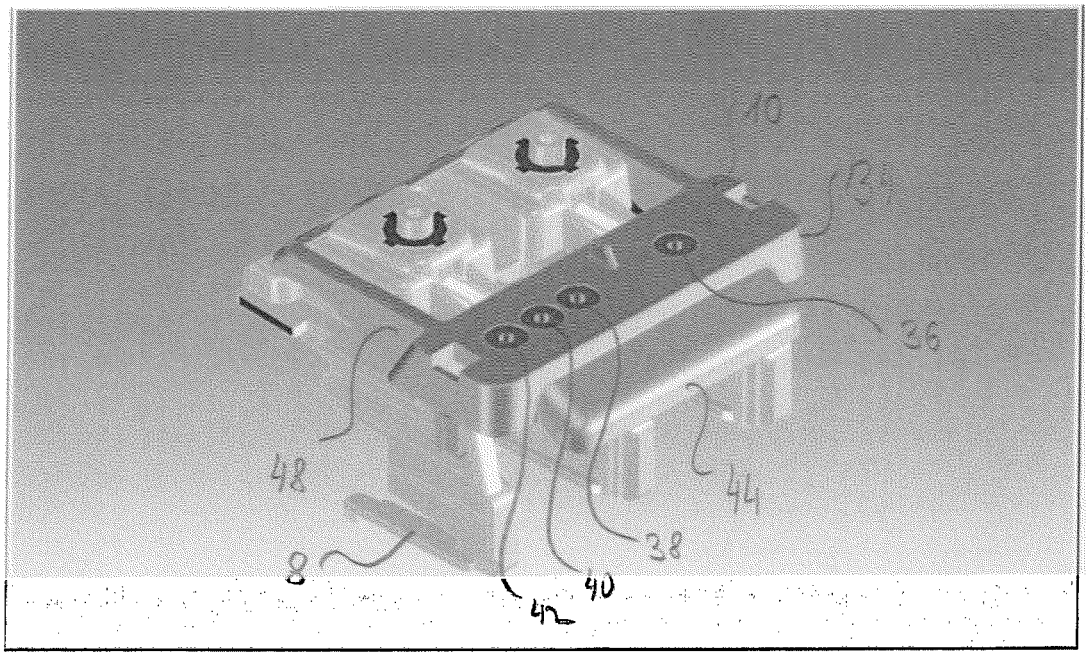
Figure 7:
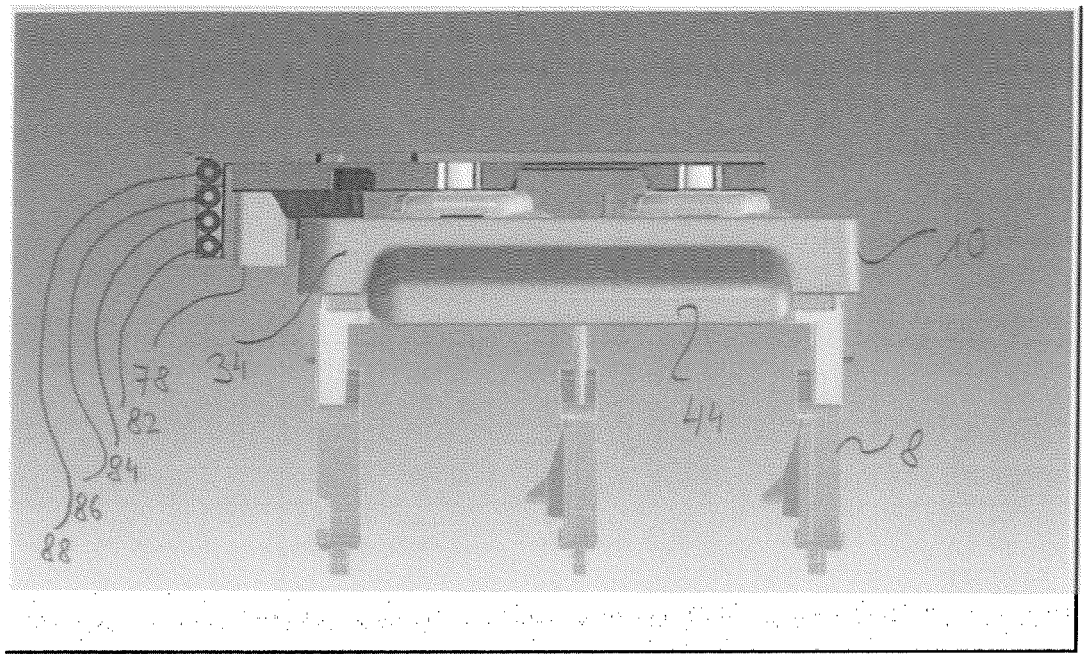
FIG. 7 is an illustration of the articulating housing of FIG. 4 arranged on a cartridge holding part of FIGS. 6*a* and 6*b* and an exemplary printing fluid supply tube support in one example.
Figure 8:
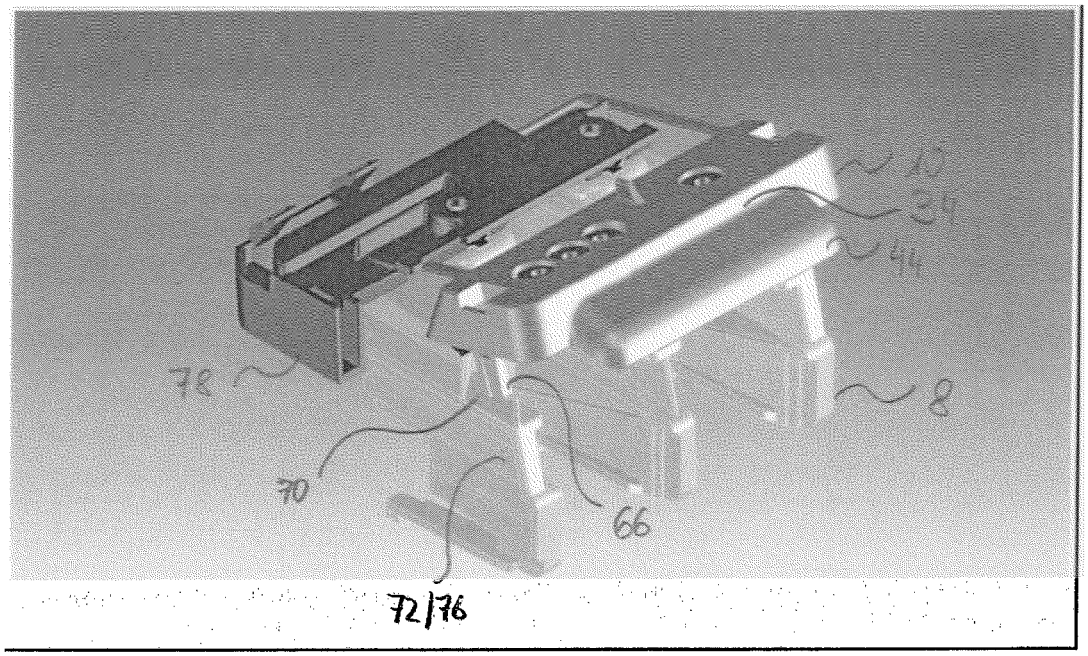
FIG. 8 is an illustration of the arrangement of FIGS. 6*a*, 6*b* and 7 in one example, wherein the articulating housing in a second articulating housing pivot position.

FIGS. 3*a* and 3*b* illustrate an arrangement including the carriage assembly of FIGS. 1*a* and 1*b* as well as the replaceable cartridge 4 of FIG. 2*a* and the replaceable cartridge 6 of FIG. 2*b*.

FIGS. 9*a* and 9*b* and FIGS. 10*a* and 10*b* illustrate another arrangement including a further carriage assembly as well as the replaceable cartridge 4 of FIG. 2*a* and the replaceable cartridge 6 of FIG. 2*b*.

Figure 9A:
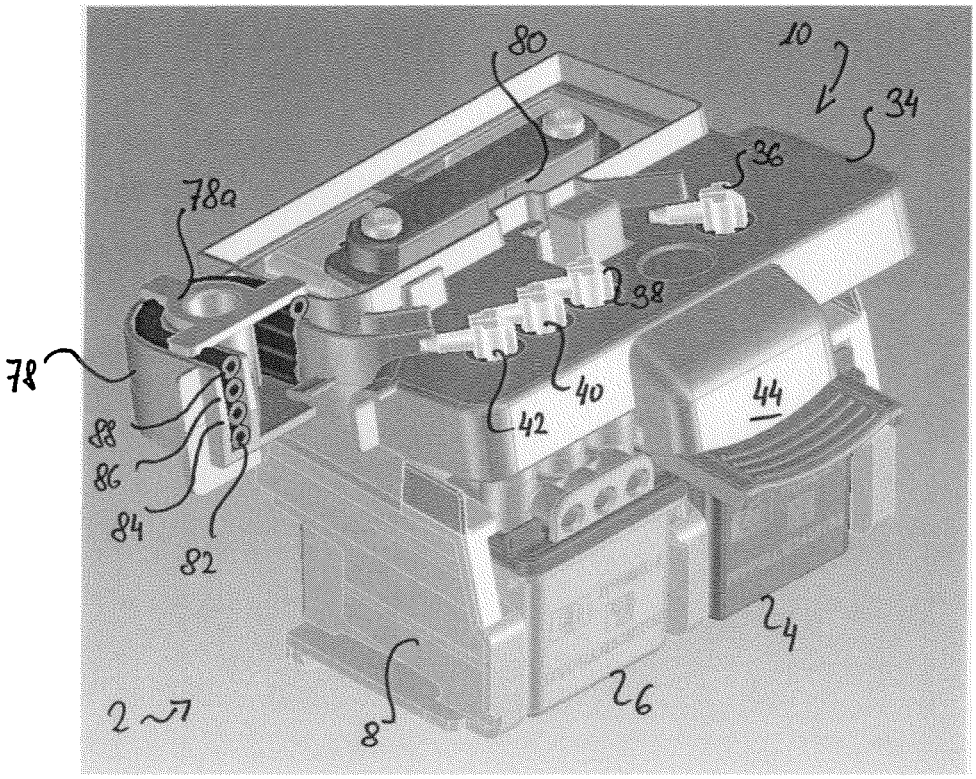
FIGS. 9*a* and 9*b* are illustrations of another example carriage assembly for a printer with an further articulating housing in a first articulating housing pivot position, in perspective view (FIG. 9*a*) and in front view (FIG. 9*b*)
Figure 9B:
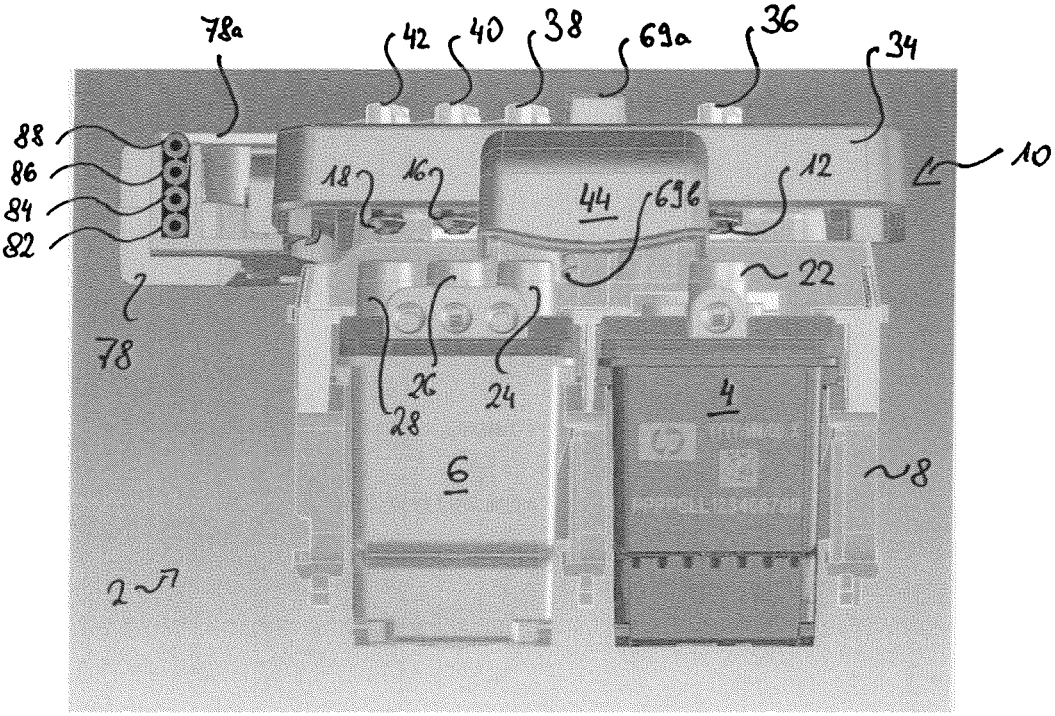

The following observations apply to both the arrangement of FIGS. 3*a* and 3*b* and the arrangement of FIGS. 9*a* and 9*b* as well as 10*a* and 10*b* unless otherwise noted.

As illustrated, the replaceable cartridges 4 and 6 are inserted into the carriage assembly holding part 8.

As illustrated, the articulating housing output port 12 and the cartridge input port 22 are associated, the articulating housing output port 14 and the cartridge input port 24 are associated, the articulating housing output port 16 and the cartridge input port 26 are associated, and the articulating housing output port 18 and the cartridge input port 28 are associated.

In FIG. 3*a*, the articulating housing 10 is in its first articulating housing pivot position and, in FIG. 3*b*, the articulating housing 10 is in its second articulating housing pivot position.

Figure 10A:
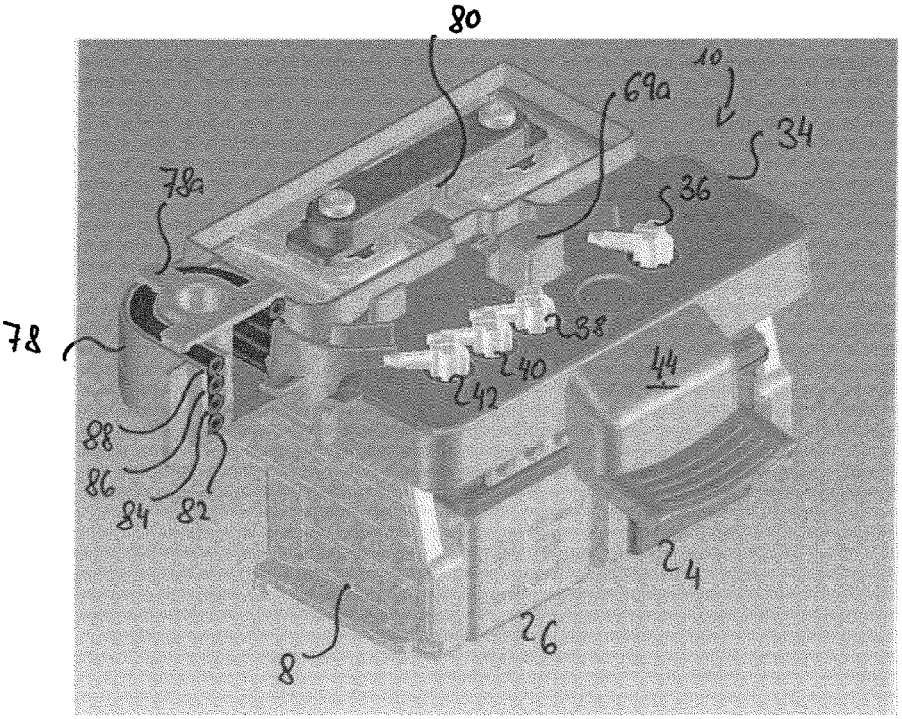
FIGS. 10*a* and 10*b* are illustrations of the carriage assembly of FIGS. 9*a* and 9*b* in a second articulating housing pivot position, in perspective view (FIG. 10*a*) and in front view (FIG. 10*b*) in one example.
Figure 10:
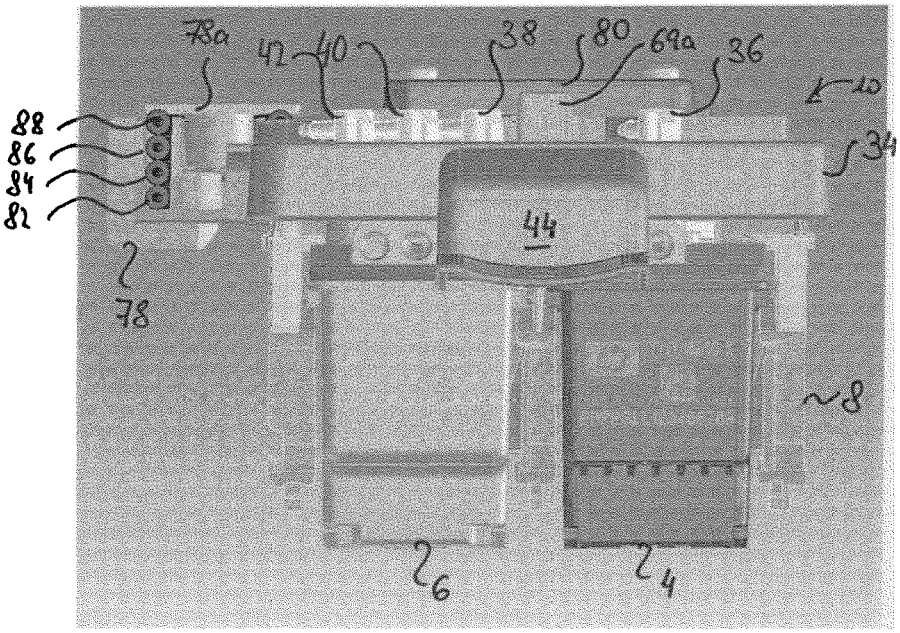

In FIGS. 9*a* and 9*b*, the articulating housing 10 is in its first articulating housing pivot position and, in FIGS. 10*a* and 10*b*, the articulating housing 10 is in its second articulating housing pivot position.

In the first articulating housing pivot position, the articulating housing output ports 12, 14, 16 and 18 are located at a distance from the respective one of the associated cartridge input ports 22, 24, 26 and 28. In this scenario, there is no coupling and, particularly, no fluid connection between an articulating housing output port and its associated cartridge input port. In other words, no printing fluid can be supplied from an articulating housing output port to its associated cartridge input port.

In the second articulating housing pivot position, the articulating housing output ports 12, 14, 16 and 18 and the respective one of the associated cartridge input ports 22, 24, 26 and 28 are coupled or engaged with each other, respectively. In particular, the articulating housing output port 12 and the cartridge input port 22 are coupled/engaged, the articulating housing output port 14 and the cartridge input port 24 are coupled/engaged, the articulating housing output port 16 and the cartridge input port 26 are coupled/engaged, the articulating housing output port 18 and the cartridge input port 26 are coupled/engaged. In this scenario, there is a coupling and, particularly, a fluid connection between each articulating housing output port and its associated cartridge input port. In other words, printing fluid can be supplied from an articulating housing output port to its associated cartridge input port, for example from the articulating housing output port 12 to the cartridge input port 22, from the articulating housing output port 14 to the cartridge input port 24, from the articulating housing output port 16 to the cartridge input port 26, and from the articulating housing output port 18 to the cartridge input port 28.

The pivoting movement of the articulating housing 2 may be used to establish a fluid connection between the articulating housing output ports 12, 14, 16 and 18 and the respective ones of the cartridge input ports 22, 24, 26 and 28 in order to allow a supply of printing fluid to the replaceable cartridges 4 and 6. In the first articulating housing pivot position, the articulating housing output ports 12, 14, 16 and 18 are not fluidly connected with (or fluidly disconnected from) the replaceable cartridges. In the second articulating housing pivot position, the articulating housing output ports 12, 14, 16 and 18 may be in fluid connection with the replaceable cartridges to supply printing fluid to the replaceable cartridges.

FIGS. 4 to 8 illustrate the articulating housing 10 of FIGS. 3*a* and 3*b*. The articulating housing 10 comprises a part, hereafter referred to an articulating housing main part 34 in non-limiting manner.

Figure 11:
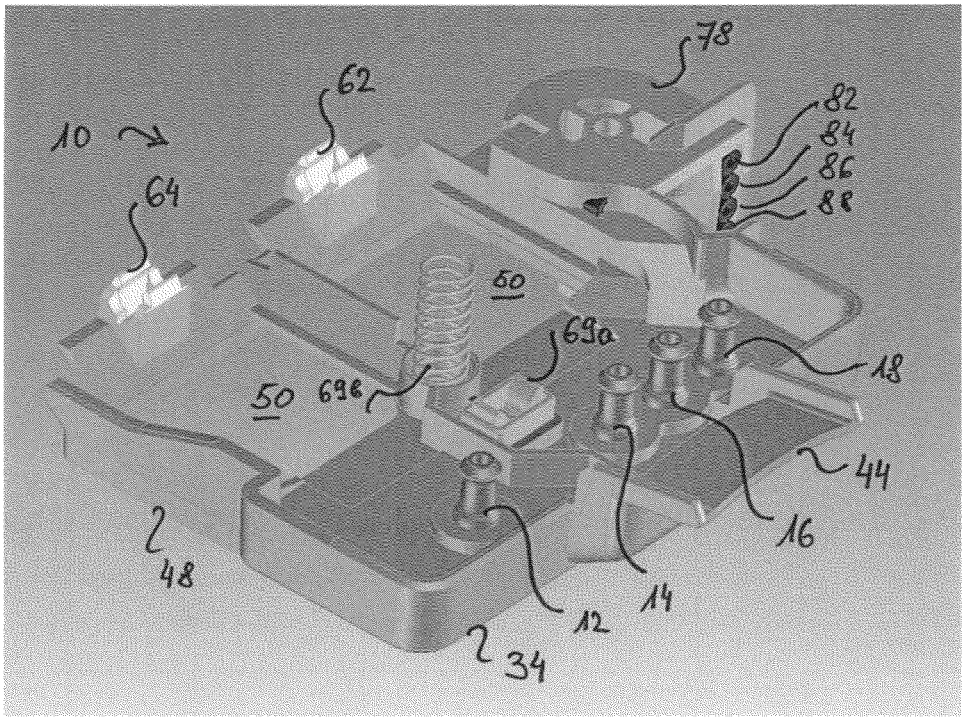
FIG. 11 is an illustration of an example articulating housing.

FIG. 11 illustrates the articulating housing 10 of FIGS. 9*a*, 9*b* and 10*a*, 10*b*.

The following observations apply to both the articulating housing of FIGS. 4 to 8 and the articulating housing of FIG. 11 unless otherwise noted.

The articulating housing 10 comprises a part, hereafter referred to an articulating housing main part 34 in non-limiting manner.

The articulating housing main part 34 may accommodate the articulating housing output ports 12, 14, 16 and 18 and articulating housing input ports 36, 38, 40 and 42. The articulating housing input port 36 is in fluid connection with the articulating housing output port 12, the articulating housing input port 38 is in fluid connection with the articulating housing output port 14, the articulating housing input port 40 is in fluid connection with the articulating housing output port 16, and the articulating housing input port 42 is in fluid connection with the articulating housing output port 18.

The articulating housing 10 comprises a handle or grip part 44, which can be used by a person to move the articulating housing 10 between its first articulating housing pivot position and its second articulating housing pivot position and, particularly from the first articulating housing pivot position into the second articulating housing pivot position and vice versa.

The articulating housing 10 comprises an articulating housing coupling part 46.

According to the illustrations, the articulating housing coupling part 46 and the articulating housing main part 34 are connected by a frame type part 48. The use of the frame type part 48 allows a light-weight construction of the articulating housing 10 minimizing the material needed and compact design of the carriage assembly 2 in total. As shown, e.g., in FIGS. 6*a* and 6*b*, other parts of the carriage assembly 2 can use the at least one free space 50 provided by the frame type part 48.

In order to pivot the articulating housing 10 with respect to the carriage assembly holding part 8, a hinge joint type coupling of the articulating housing 10 can be used. According to the figures, the articulating housing coupling part 46 is used, which enables a pivotable coupling or connection with the carriage assembly holding part 8 and, particularly, with cartridge latches 52 and 54.

The cartridge latches 52 and 54 can be also referred to as "pen latches". The cartridge latches 52 and 54 respectively comprise a cartridge engagement part 56 and 58, which serves to engage with a respective portion of a replaceable cartridge to hold the same in the carriage assembly 2. To release or insert a replaceable cartridge, the cartridge latches 52 and 54 can be (e.g. independently) pivoted about a cartridge latch pivot axis 60 in order disengage or engage, respectively, a one or both of the cartridge engagement parts 56 and 58 form the respective replaceable cartridge.

The articulating housing coupling part 46 is coupled to cartridge latches 52 and 54 by means articulating housing hinges 62 and 64. This allows to pivot the articulating housing 10 about the same axis as the cartridge latches 52 and 54, i.e. the cartridge latch pivot axis 60. In other words, the articulating housing pivot axis 20 and the cartridge latch pivot axis 60 are axially aligned.

As shown in FIGS. 4 to 8, the articulating housing 10 comprises a holding part 66, which can be also referred to as positioning part due to its function and operation. The holding/positioning part 66 comprises at least one latch leg 68.

In the first articulating housing pivot position, the at least one latch leg 68 engages with a respective one of at least one first engagement part 70 of the carriage assembly holding part 8 to position the articulating housing 10 in the first articulating housing pivot position (see also FIG. 1*b*). As illustrated, for this engagement, the at least one latch leg 68 rests on the respective one of at least one first engagement part 70.

In the second articulating housing pivot position, the at least one latch leg 68 engages with a respective one of at least one second engagement part 72 of the carriage assembly holding part 8 to hold the articulating housing 10 in the second articulating housing pivot position (see also FIGS. 1*b* and 3*b*). As illustrated, for this engagement, the at least one latch leg 68 may comprise a nose 70 engaging with a recess 76 (e.g. slot or notch) acting as second engagement part.

The rotation of the articulating housing 10 about its pivot axis 20 may be limited, for in the range of approximately 5 degrees, 10 degrees, 15 degrees, 20 degrees or any other range, for example suitable to allow sufficient space to insert and remove a replaceable cartridge.

The rotation towards the second articulating housing pivot position can be limited by the engagement of the at least one latch leg 68 with the respective one of at least one second engagement part 72.

As shown in FIG. 11, the articulating housing 10 comprises a holding part 66, which can be also referred to as positioning part due to its function and operation. The holding/positioning part 66 comprises at least one latch device 69*b* and at least one elastic device 69*b*. The at least one elastic device 69*b* can be comprise a spring.

With respect to the first articulating housing pivot position, the at least one elastic device 69*b* engages with an upper surface of the carriage assembly holding part 8 (e.g. on the respective one of at least one first engagement part 70) and positions and maintains, respectively, the articulating housing 10 in the first articulating housing pivot position.

In the second articulating housing pivot position, the at least one latch device 69*a* engages with a complementary formed structure of the carriage assembly holding part 8 and couples the articulating housing 10 and the carriage assembly holding part 8, for example, in from of a snap-connection.

In order to change the articulating housing 10 from the first articulating housing pivot position to the second articulating housing pivot position, the articulating housing 10 can be moved against the elastic device 69*b* towards the carriage assembly holding part 8 until the latch device 69*a* engages and holds the articulating housing 10 in the second articulating housing pivot position. To this end, the articulating housing 10 can be moved by using the articulating housing handle or grip part 44.

In order to change the articulating housing 10 from the second articulating housing pivot position to the first articulating housing pivot position, the articulating housing 10 can be moved away from the carriage assembly holding part 8 to disengage the latch device 69*a*. To this end, the articulating housing 10 can be moved by using the articulating housing handle or grip part 44. This process can be supported by elastic forces provided by the elastic device 69*b*.

Again with respect to FIGS. 4 to 8 and FIG. 11, it is noted that the rotation of the articulating housing 10 about its pivot axis 20 may be limited, for in the range of approximately 5 degrees, 10 degrees, 15 degrees, 20 degrees or any other range, for example suitable to allow sufficient space to insert and remove a replaceable cartridge.

The rotation towards the second articulating housing pivot position can limited by the engagement of the at least one latch leg 68 with the respective one of at least one second engagement part 72.

The rotation towards the first articulating housing pivot position can limited by an engagement the articulating housing 10 and another part of the carriage assembly 10. Such a limitation can be provided by engagement of a part of the articulating housing 10 and a printing fluid supply tube support 78. This is illustrated in 8, where an engagement portion 80 of the articulating housing frame type part 48 engages a part of the printing fluid supply tube support 78. The engagement portion 80 of the articulating housing frame type part 48 can be referred to as articulating housing stop part and the respective part of the printing fluid supply tube support 78 can be referred to as carriage assembly stop part.

As shown in FIGS. 4 to 8 and FIG. 11, the printing fluid supply tube support 78 can support at least one printing fluid supply tube, for printing fluid supply tubes 82, 84, 86 and 88 In operation/use of the printer system, the printing fluid supply tubes may supply printing fluid from a respective fluid supply of the printer system, e.g. in the form of fluid tanks.

The printing fluid supply tube support 78 may be part of the articulating housing 10 or the carriage assembly holding part 8. In either case, the printing fluid supply tube support 78 may have features for controlling and/or securing at least one printing fluid supply tube. For example, a tube cap 78*a* may be used in order to hold printing fluid supply tubes in the printing fluid supply tube support 78.

As illustrated in the drawings, it is contemplated to have one of the printing fluid supply tubes 82, 84, 86 and 88 associated with one of the articulating housing input ports 36, 38, 40 and 42. The term "associated" may encompass coupling, such as physical coupling directly with each other or by indirectly by an intermediate member like an intermediate printing fluid conduit, line and the like, connecting, such as fixed or rigid connection. The printing fluid supply tube support 74 can, as shown, hold the printing fluid supply tubes 82, 84, 86 and 88 in a vertical stack.

The articulating housing output ports 12, 14, 16 and 18 are arranged in a linear fashion, particularly parallel to the articulating housing pivot axis 20. The articulating housing output ports 12, 14, 16 and 18 are arranged such that they can engage/couple with the respective one of the cartridge input ports 22, 24, 26 and 28. To this end, and taking into account the arrangement of the cartridge input ports 22, 24, 26 and 28 of the replaceable cartridges 4 and 6, the exemplary articulating housing output ports 12, 14, 16 and 18 are arranged such that one articulating housing output port 12 is located at some distance from the remaining articulating housing output ports 14, 16 and 18, which may be evenly spaced.

The hinging of the articulating housing 10 enables an at least approximately linear engagement process/movement for the articulating housing output ports 12, 14, 16 and 18 and the cartridge input ports 22, 24, 26 and 28.

The invention claimed is:

1. An articulating housing for a carriage assembly of a printer system, the articulating housing comprising:

an articulating housing output port to supply printing fluid to a input port of a replaceable cartridge to be held in the carriage assembly; and an articulating housing coupling part to establish an articulated coupling between the articulating housing and the carriage assembly to pivot the articulating housing around an articulating housing pivot axis from a first articulating housing pivot position, in which the articulating housing output port is not fluidly connected with the cartridge input port and in which the cartridge is removable from the articulating housing, to a second articulating housing pivot position, in which the articulating housing output port is fluidly connected to the cartridge input port, wherein in transitioning from the first articulating housing pivot position to the second articulating housing pivot position, the articulating housing output port mates with the cartridge in a rotational motion.

2. The articulating housing according to claim 1, wherein the articulating housing coupling part includes a latch to establish a hinge joint type coupling with the carriage assembly.

3. The articulating housing according to claim 1, wherein the carriage assembly includes a cartridge latch to latch the replaceable cartridge in the carriage assembly, wherein the cartridge latch is pivotable about a cartridge latch pivot axis from a first cartridge latch position to release the replaceable cartridge from the carriage assembly into a second cartridge latch position to latch the replaceable cartridge in the carriage assembly, wherein the articulating housing pivot axis is axially aligned with the cartridge latch pivot axis.

4. The articulating housing according to claim 1, wherein the articulating housing output port includes a flexible needle type connector.

5. The articulating housing according to claim 1, further including a holding part to hold the articulating housing in the first articulating housing pivot position and to hold the articulating housing in the second articulating housing pivot position, wherein the holding part includes a latch leg to engage with a first engagement part of the carriage assembly in the first articulating housing pivot position and to engage with a second engagement part of the carriage assembly in the second articulating housing pivot position, or the second engagement part of the carriage assembly includes a recess and the latch leg is to engage the second engagement part of the carriage assembly to establish a releasable latch coupling of the articulating housing and the carriage assembly.

6. The articulating housing according to claim 1, wherein the carriage assembly includes a carriage assembly stop part, and the articulating housing includes an articulating housing stop part to engage with the carriage assembly stop part in the first articulating housing pivot position.

7. The articulating housing according to claim 1, wherein the articulating housing output port includes two articulating housing output ports arranged in linear fashion parallel to the articulating housing pivot axis.

8. The articulating housing according to claim 1, wherein the articulating housing includes an articulating housing input port for a fluid connection to a printing fluid source of the printer system and supply of printing fluid to the articulating housing output port.

9. A carriage assembly for a replaceable cartridge for a printer system, the carriage assembly comprising:

a cartridge holding part to replaceably hold a replaceable cartridge;

a carriage assembly coupling part; and an articulating housing according to claim 1, wherein the articulating housing coupling part is articulatedly coupled to the carriage assembly coupling part to pivot the articulating housing around an articulating housing pivot axis from a first articulating housing pivot position, in which the articulating housing output port is not fluidly connected with a cartridge input port of the replaceable cartridge, to a second articulating housing pivot position, in which the articulating housing output port is fluidly connected to the cartridge input port.

10. The carriage assembly according to claim 9, further including a cartridge latch to latch the replaceable cartridge in the carriage assembly, wherein the cartridge latch is pivotable about a cartridge latch pivot axis from a first cartridge latch position to release the replaceable cartridge from the carriage assembly into a second cartridge latch position to latch the replaceable cartridge in the carriage assembly, wherein the articulating housing pivot axis is axially aligned with the cartridge latch pivot axis.

11. The carriage assembly according to claim 9, further including a first engagement part of the carriage assembly engaged with the articulating housing in the first articulating housing pivot position and a second engagement part engaged with the articulating housing in the second articulating housing pivot position.

12. The carriage assembly according to claim 9, wherein the carriage assembly includes a carriage assembly stop part to engage with the articulating housing in the first articulating housing pivot position.

13. The carriage assembly according to claim 9, further including a printing fluid supply tube support to support a fluid supply tube for fluid connection with a printing fluid supply of the printer system and to supply the printing fluid to the articulating housing output port.

14. A printer system including a carriage assembly for a replaceable cartridge, the replaceable cartridge including a cartridge input port for supply of printing fluid thereto, the carriage assembly comprising:

a cartridge holding part to replaceably hold the replaceable cartridge;

a carriage assembly coupling part; and an articulating housing according to claim 1, wherein the articulating housing coupling part is articulatedly coupled to the carriage assembly coupling part to pivot the articulating housing around an articulating housing pivot axis from a first articulating housing pivot position, in which the articulating housing output port is not fluidly connected with the cartridge input port, to a second articulating housing pivot position, in which the articulating housing output port is fluidly connected to the cartridge input port.

15. The articulating housing of claim 1, wherein in transitioning from the first articulating housing pivot position to the second articulating housing pivot position, the articulating housing output port mates with the cartridge input port in the rotational motion.

* * * * *